United States Patent [19]

Bochard et al.

[11] Patent Number: 4,695,684

[45] Date of Patent: Sep. 22, 1987

[54] ELECTRIC SAFETY SWITCH

[75] Inventors: Michel Bochard, Ruelle; Michel Lafaye, Angouleme, both of France

[73] Assignee: La Telemecanique Electrique, France

[21] Appl. No.: 840,833

[22] Filed: Mar. 18, 1986

[30] Foreign Application Priority Data

Mar. 18, 1985 [FR] France ..... 85 03938

[51] Int. Cl.[4] ..... H01H 27/00

[52] U.S. Cl. ..... 200/43.07; 200/43.04; 200/153 LA

[58] Field of Search ..... 200/43.01, 43.04, 43.07, 200/43.09, 153 L, 153 LA

[56] References Cited

U.S. PATENT DOCUMENTS 4,066,856 1/1978 Merkle ..... 200/43.07

4,395,608 7/1983 Eicker et al. ..... 200/43.07

4,454,392 6/1984 Rapp et al. ..... 200/43.07

4,524,251 6/1985 Schulz ..... 200/43.07

*Primary Examiner*—Stephen Marcus

*Assistant Examiner*—Linda J. Sholl

*Attorney, Agent, or Firm*—William A. Drucker

[57] ABSTRACT

An electric safety switch is provided which can only be actuated by means of a key carried by a movable part of an installation.

With its ramp the key causes retraction of a bolt which is carried by a dividing wall of a rotary sector and, with its finger, causes the angular driving of a groove of this dividing wall, this latter entirely covering the cam surfaces which actuate the switch pusher.

These switches are advantageously used in installations such as elevators and in safety circuits associated with cabinet doors.

3 Claims, 3 Drawing Figures

ELECTRIC SAFETY SWITCH

BACKGROUND OF THE INVENTION

1. Field of the Invention

The invention relates to a safety switching apparatus comprising a case, an electric switch adapted to be actuated by a longitudinally mobile pusher when one end thereof, extending into a transverse window of the case, receives a movement which is communicated thereto by rotary transmission means cooperating with a key introduced transversely in this window and such that this movement cannot be communicated thereto in the absence of the key.

2. Description of the Prior Art

Such a switching apparatus, which is for example used in safety circuits where the state of the switch must only be able to be modified by the position of a door, in which this key is placed, is known more particularly from French patent No. 2 498 004.

In this known apparatus, it may be feared that the key, which is formed by a metal wire loop, may be subject to accidental deformations which may make the subsequent operation thereof difficult.

In addition, the use of a rotary member, which has a symmetrical trend so as to make actuation possible in one of several directions, means that the pusher cannot be given a substantial stroke unless very sloping cam surfaces are provided on this member, which could cause undesirable friction, even jamming. Finally, the very shape of the key does not guarantee that an unauthorized person may actuate the switch with a means equivalent to this key.

SUMMARY OF THE INVENTION

The invention provides then a switch having the above mentioned construction which further comprises transmission means which, on the one hand, will have harmoniously stepped actuating surfaces over a substantial angular stroke and which, on the other hand, will cooperate with locking means making any attempt at fraud and any access to the pusher extremely difficult.

The fact must be taken into consideration that the use of a locking means is not alone sufficient to provide substantial benefit if there exists in other respects direct access to the switch pusher or its extension; in fact, if such were the case, and if the useful actuation of this pusher were effected by exerting a push, appropriate means could be slid towards it for thwarting the protective measures; if, on the other hand, useful actuation of this pusher were to be provided by a relaxing or tractive effect, the same fraudulent attempts could result in damage to the switch.

According to the invention, the desired end is reached because the transmission means are represented by a rotary cam sector, whose pivoting axis parallel to the longitudinal axis of the pusher is offset with respect thereto, so as to have helical actuating surfaces which are spaced apart from this pivoting axis, and which cooperate with the end of the pusher, and because the locking means comprise, on the one hand, a transverse dividing wall of this sector, which is continuous over the whole extent of the sector so as to prevent access to this end, which has on the side opposite the actuating surfaces a radial drive groove adapted for cooperating with a stud carried by a solid key and further having a retractable angular locking projection which has no direct connection with the pusher, which is carried by this dividing wall and which retracts so as not to abut against the case when the key is placed in the opening.

BRIEF DESCRIPTION OF THE DRAWINGS

The invention will be better understood from reading the description with reference to the three accompanying Figures in which.

DESCRIPTION OF THE PREFERRED EMBODIMENT

Figure 1:
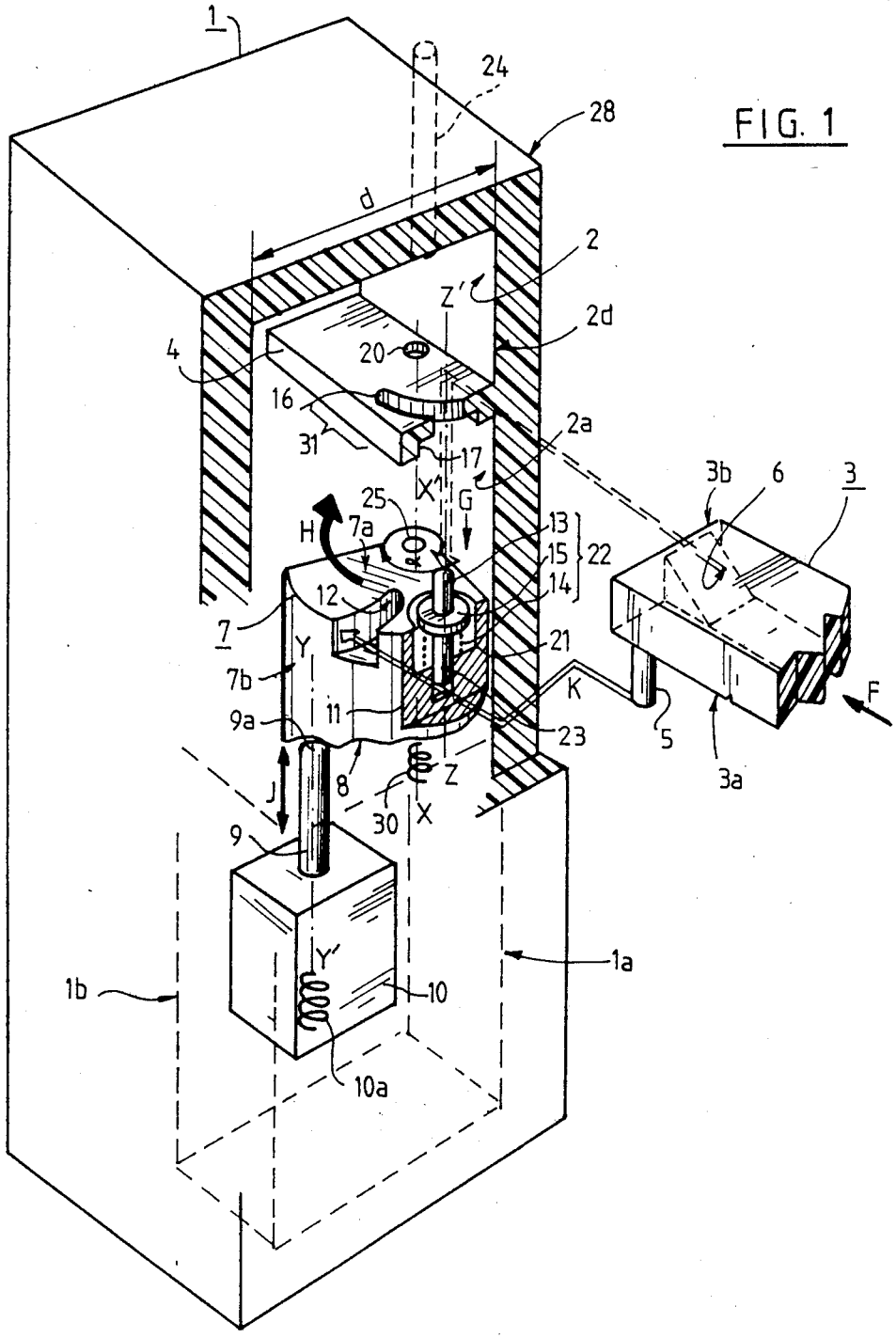
FIG. 1 shows a partially exploded perspective view of an apparatus according to the invention.

A safety switch case 1 in accordance with the invention, which is shown in FIG. 1, comprises a window 2 which opens on one of its faces 1*a* at the upper part. This window has dimensions and a contour which allow a particular solid key 3 to penetrate therein in the direction F. This key comprises, in addition to a cylindrical stud or projection 5 placed on one face 3*a*, an inclined ramp 6 which extends between this face 3*a* and the end 3*b* of the key.

In window 2 is placed a wall 4 parallel to the direction F, which only occupies a fraction of the width -d- of this window and which overhangs a space 2*a* placed thereunder, in which is disposed a piece 7 mounted for rotation about a longitudinal axis XX' perpendicular to F. This piece which has the form of a cylinder sector with for example an angular extend $\alpha$ close to 90°, comprises in its lower region opposite the wall a helical surface 8, possibly provided with notches or projections, which cooperate with one end 9*a* of pusher 9 belonging to an electric switch 10 or extending it, the axis YY' of movement of this pusher being substantially parallel to the axis XX'.

Figure 3:
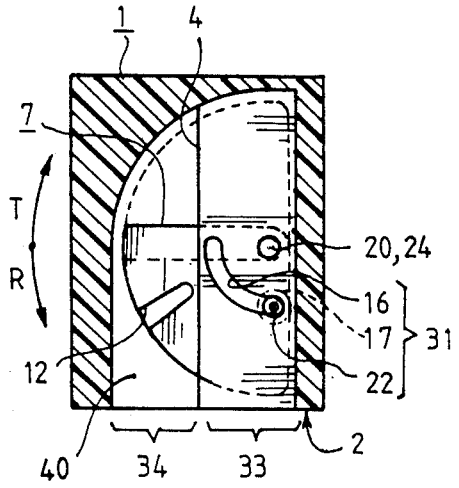
FIG. 3 shows a top view of FIG. 2 in a section through the plane QQ'.

Note that means for holding the body of the switch in position, which are not shown, are disposed in a cavity 1*b* of the case which receives it and that sealing means confer on pusher 9 the possibility of sealingly sliding between this cavity and space 2*a* for example at the level of a second transverse wall 40, see FIG. 3.

The rotary piece 7 comprises a solid dividing wall 11 which extends perpendicular to the axis XX' and angularly over the whole extend $\alpha$, so that the end 9*a* is constantly covered by this dividing wall for the different angular positions which piece 7 may assume in space 2*a* between rest R and working T positions, see broken lines and dotted lines in FIG. 3.

The upper surface 7*a* of the rotary piece 7 comprises, on the one hand, a substantially radial groove 12 which opens laterally in the cylindrical surface 7*b* and, on the other hand, a cylindrical housing 21 in which is guided, along an axix ZZ' parallel to XX', a bolt 22 which is formed by a piece of revolution having an end 13, a collar 15 and a rod 23 which ensures guidance thereof; a spring 14 placed under compression between the bottom of the housing and the collar applies to this bolt a thrust directed upwardly in FIG. 1.

When the rotary piece 7 is mounted in space 2*a* of the case, for example by means of a pivot pin 24 passing through a hole 20 in wall 4 and the bore 25 of this piece, the axis ZZ' of bolt 22 is situated opposite a curved groove 16 which passes through the wall concentrically to the hole 20.

In its rest position R, illustrated in FIG. 1, the rotary piece 7 places the collar 15 opposite a circular recess or cylindrical facing 17 placed under the wall, and this collar penetrates therein under the effect of spring 14 while immobilizing piece 7 angularyly.

Figure 2:
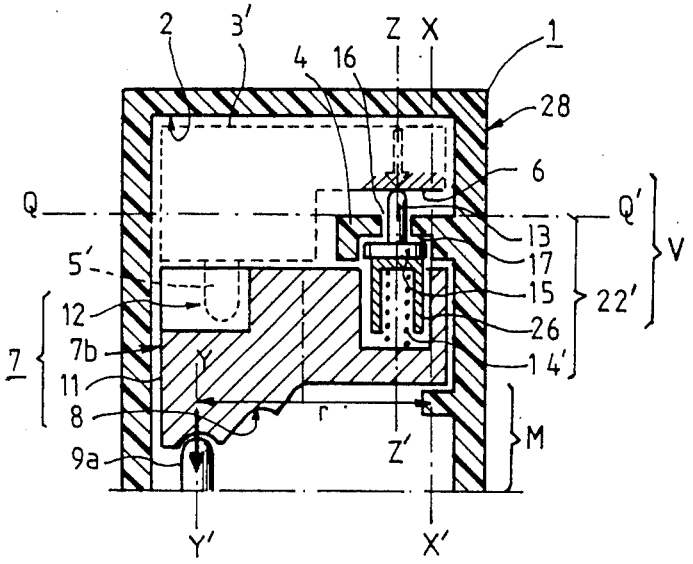
FIG. 2 shows in section a partial front view of a switching device, only having, with respect to the preceding one, a variant of the locking means.

In this position, the end 13 which passes through groove 16 projects above wall 4 and extends through window 2 by a certain length, as can be seen in FIG. 2.

When the key 3 is introduced in the direction F in window 2, the inclined ramp 6 which slides above wall 4 pushes the end 13 back in the sense G and thus gives to the collar 15 a position which frees it from the housing 17; the stud 5 of the key which is at that time opposite the entrance of the groove 12, then penetrates more deeply therein and exerts tangentially, on the radial surface of the groove, a thrust in direction K which causes the application of a torque and rotation H of the rotary piece, whereas the surface 3*a* of the key maintains the retraction of the bolt, this latter then moving the end 13 into groove 16.

This rotational movement, through the relative movement of the cam surface 8 and pusher 9, causes this latter to rise, for example under the effect of a spring 10*a*, which results in a change of state of the switch in direction J.

When the key is withdrawn from the window, reverse movements cause successively reverse situations.

FIG. 2 shows, in a general structure identical to the preceding one, that the bolt 22' may have a box like shape and receive inwardly a thrust spring 14', guidance thereof then being provided by the skirt 26; furthermore, key 3' has in this case a section adapted particularly to the shape of window 2, so that the stud 5' may be shorter than in the preceding case.

It can also be seen in this second Figure that the pivoting axis XX' of piece 7 is placed in the vicinity of the face 28 of the case, which gives to the helical surfaces 8 a relatively large radius -r-, without for all that increasing the size of the case 1.

The result is that the slope of these surfaces becomes small and that piece 7 which serves as transmission means M between the key and the pusher is able to fulfill its function with very good efficiency.

Moreover, the fact of placing the housing 17 of the locking device -v- in the front part 31 of piece 7 placed on the entrance 2*d* side of window 2, see FIG. 3, means that key 3 can provide unlocking as soon as it begins penetration therein; this means that the length of this key may be small and that, consequently, the difficulties of alignment of this key (fixed for example on a door) with the window will be reduced, whereas its rigidity will be increased.

To respond to a need for additional safety, which is intended to make a fraudulent attempt even more difficult, the rotary piece 7 receives from a resilient means 30, bearing for example on the case, for example a torsion or compression spring, a return torque towards the rest position, so oriented in a direction the opposite of H; this torque thus tends to drive away from the window any object which might have been fraudulently inserted therein with a view to applying a torque in direction H to this piece.

Finally, for adapting the section of the key, see FIG. 3, as well as possible to the useful surface of the window, wall 4 only extends into region 33 which partially covers piece 7 and which is separate from the region 34 covered by the drive groove 12 during rotation.

What is claimed is

1. A safety switch comprising:

i. a case and a partition wall in said case forming first and second chambers therein and leaving a passage from the first to the second chambers; said partition wall having a slot shaped as an arc of a circle and a locking recess;

ii. A switch unit housed in the second chamber and having an elongate pusher movable along a direction at right angles with said partition wall;

iii. a rotary cam shaped as a cylindrical sector mounted for rotating in the second chamber about an axis parallel to said direction and passing through the center of said circle, from a first to a second angular position, said cam having a first end surface facing said partition wall, a second end cam-shaped surface, engaging said pusher to switch the switch unit, when the cam passes from its first to its second angular position, and a cylindrical side surface, said cam further having a radial groove defining a driving surface for the cam and opening on said first end surface and on said side surface and an elongate housing defining a guiding surface in a direction parallel to said axis;

iv. a spring-actuated retractable locking member mounted for moving along said guiding surface from a first to a second positions and having a shoulder which engages said locking recess to prevent rotation of the cam when the locking member is in its first position and an end portion which projects beyond said shoulder through said slot when the locking member is in its first position;

v. a key form fittingly engageable into the first chamber and having an inclined surface portion which pushes said end portion to disengage said shoulder from said locking recess and moves the locking member into its second position, said key further having a stud which passes through said passage and engages the driving surface of the radial groove for rotating said cam from its first to its second positions.

2. A safety switch as claimed in claim 1, wherein the side surface of the rotary cam is arranged for preventing access to said elongate pusher from outside the case.

3. A safety switch as claimed in claim 1, wherein the key is engageable into the first chamber in a further direction at right angles with the axis of the rotary cam and said partition wall is an elongate plate having a longitudinal dimension parallel to said further direction and, along said further direction, front and bottom adjacent surface portions, said slot and said locking recess being located in the front surface portion, said elongate plate engaging the first end surface of the rotary cam in a first region thereof, whereas the radial groove opens on the first end surface in a second region thereof which is registering with said passage.

* * * * *

UNITED STATES PATENT AND TRADEMARK OFFICE

CERTIFICATE OF CORRECTION

PATENT NO. : 4,695,684

DATED : September 22, 1987

INVENTOR(S) : Michel Rochard et al.

It is certified that error appears in the above-identified patent and that said Letters Patent are hereby corrected as shown below:

Title page:

(75) Inventors: Michel Rochard, Ruelle; Michel Lafaye, Angouleme, both of France Signed and Sealed this Twenty-third Day of February, 1988

*Attest:*

DONALD J. QUIGG

*Attesting Officer*

*Commissioner of Patents and Trademarks*